US007264240B1

(12) United States Patent
Lee

(10) Patent No.: US 7,264,240 B1
(45) Date of Patent: Sep. 4, 2007

(54) DOCUMENT FEEDER

(75) Inventor: Hsin-Wen Lee, Taipei (TW)

(73) Assignee: Primax Electronics Ltd., Taipei (TW)

( * ) Notice: Subject to any disclaimer, the term of this patent is extended or adjusted under 35 U.S.C. 154(b) by 0 days.

(21) Appl. No.: 11/470,714

(22) Filed: Sep. 7, 2006

(30) Foreign Application Priority Data

Jun. 30, 2006 (TW) ..... 95123792 A

(51) Int. Cl.
*B65H 5/06* (2006.01)

(52) U.S. Cl. ..... 271/273; 271/274; 271/117; 400/637.1; 400/636.3

(58) Field of Classification Search ..... 271/273, 271/274; 400/637, 636, 637.1, 636.3
See application file for complete search history.

(56) References Cited

U.S. PATENT DOCUMENTS 1,270,292 A * 6/1918 Hess ..... 400/637.1
1,988,189 A * 1/1935 Dobson ..... 400/637.1
4,641,830 A * 2/1987 Okuda et al. ..... 271/274
4,688,958 A * 8/1987 Tajima ..... 400/636.3
5,221,035 A * 6/1993 Suzuki et al. ..... 226/181
6,139,011 A * 10/2000 Huang et al. ..... 271/274

FOREIGN PATENT DOCUMENTS

JP 02152839 A * 6/1990

* cited by examiner

*Primary Examiner*—Patrick Mackey
*Assistant Examiner*—Kaitlin S Joerger
(74) *Attorney, Agent, or Firm*—Kirton & McConkie; Evan R. Witt

(57) ABSTRACT

A document feeder includes a housing, a control lever and a sheet pick-up module. The housing includes a feeding path defined by a first sidewall and a second sidewall. The control lever is mounted on the first sidewall, and includes a pivotal part, a collar and a handle part. The collar is arranged between the pivotal portion and the handle part. The sheet pick-up module includes a driving shaft mounted on the collar and the second sidewall.

7 Claims, 5 Drawing Sheets

DOCUMENT FEEDER

FIELD OF THE INVENTION

The present invention relates to a document feeder, and more particularly to a document feeder for removing the jammed paper and detaching an abraded sheet pick-up module by adjusting a control lever thereof.

BACKGROUND OF THE INVENTION

Image capturing apparatuses such as image scanners or multifunction peripherals are widely used for capturing or scanning images of documents. As known, the image capturing apparatus usually has a document feeder for successively and continuously feeding many paper sheets one by one. Next, a further processing operation such as a scanning or printing operation is performed on the documents, which are fed by the document feeder.

As known, a conventional document feeder has a sheet pick-up module arranged in the sheet feeding path and in contact with the front edges of the documents for feeding the paper sheets one by one. In addition, the document feeder has a paper release lever. In a case of having difficulty removing the jammed paper, the user may press and hold the paper release lever while pulling out the jammed paper. Since the sheet pick-up module of the document feeder is readily suffered from abrasion when it has been used for a long term, the abraded sheet pick-up module may be replaced with a new one. For example, the document feeder of a commercial available multifunction peripheral CANON DR-1210C Document Scanner includes a paper release lever for pulling out the jammed paper and a specific replacement mechanism for replacing the abraded sheet pick-up module.

The paper release lever and the specific replacement mechanism, however, increase complexity and fabricating cost of the document feeder.

In views of the above-described disadvantages resulted from the prior art, the applicant keeps on carving unflaggingly to develop an improved document feeder according to the present invention through wholehearted experience and research.

SUMMARY OF THE INVENTION

It is an object of the present invention to provide a document feeder for removing the jammed paper and detaching an abraded sheet pick-up module by adjusting a control lever thereof.

In accordance with an aspect of the present invention, there is provided a document feeder. The document feeder includes a housing, a control lever and a sheet pick-up module. The housing includes a feeding path defined by a first sidewall and a second sidewall. The control lever is mounted on the first sidewall, and includes a pivotal part, a collar and a handle part. The collar is arranged between the pivotal portion and the handle part. The sheet pick-up module includes a driving shaft mounted on the collar and the second sidewall.

In an embodiment, the document feeder further comprises a base between the first sidewall and the control lever for supporting the pivotal part of the control lever.

In an embodiment, the control lever and the base include a salient portion and an indentation portion, respectively. The control lever is fixed onto the base when salient portion is engaged with the indentation portion.

In an embodiment, the base further includes a guiding slot having an entrance and an arc-shape bottom surface. The pivotal part of the control lever glides along the guiding slot through the entrance and is supported on the arc-shape bottom surface.

The above objects and advantages of the present invention will become more readily apparent to those ordinarily skilled in the art after reviewing the following detailed description and accompanying drawings, in which:

DETAILED DESCRIPTION OF THE PREFERRED EMBODIMENT

Figure 1A:
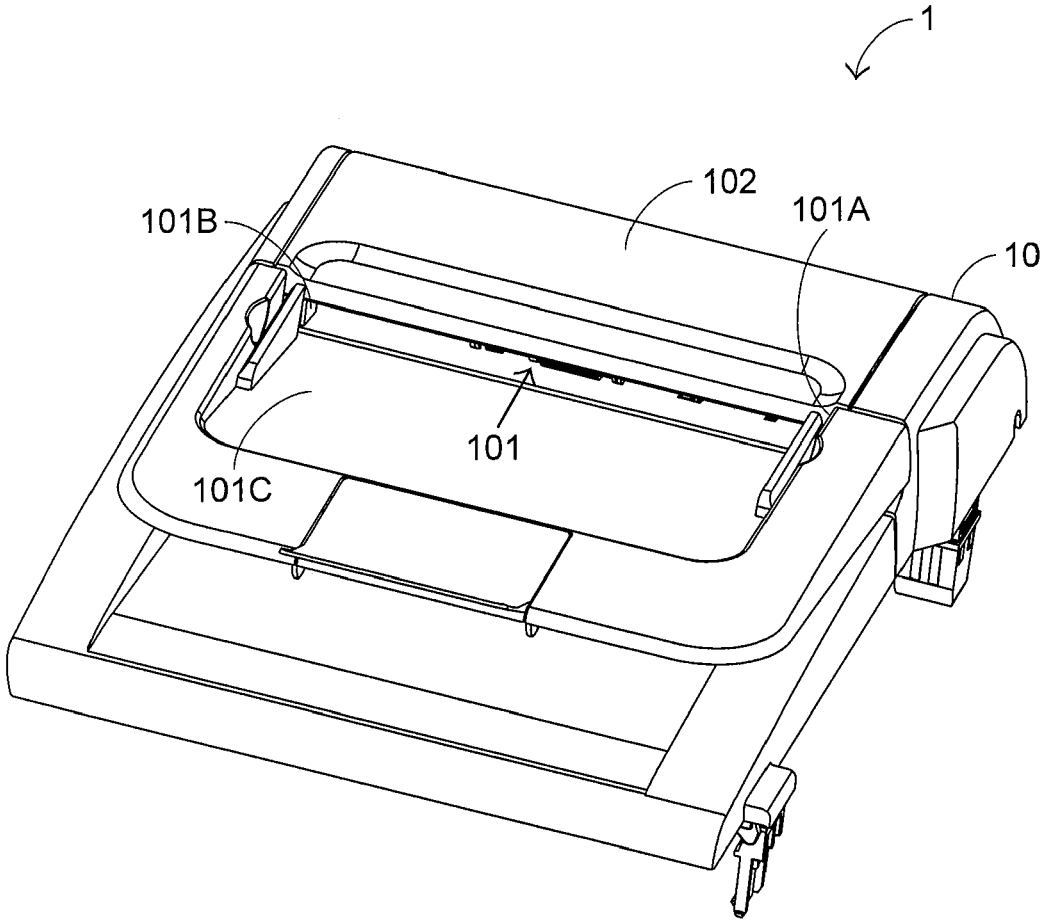
FIG. 1A is a schematic perspective view of a document feeder according to a preferred embodiment of the present invention.
Figure 1B:
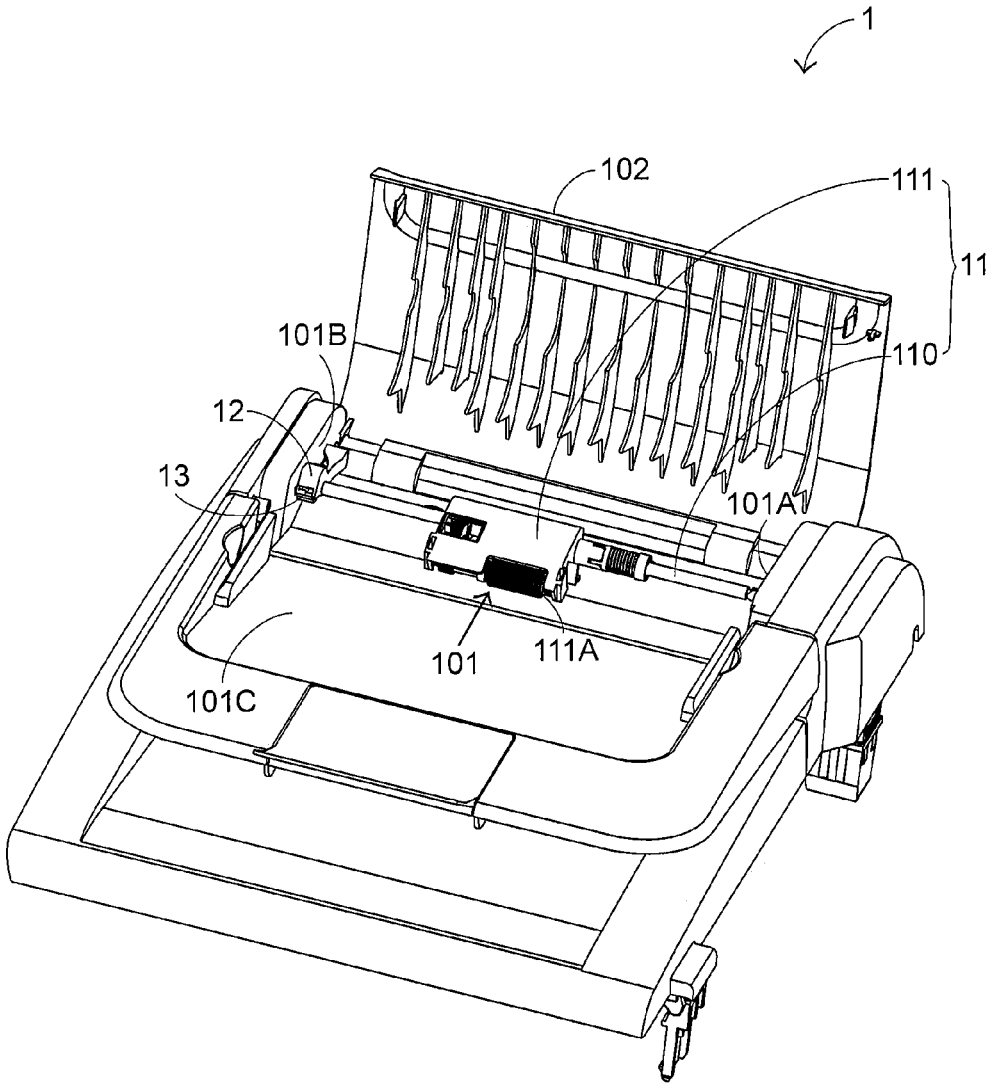
FIG. 1B is a schematic perspective view illustrating the document feeder of FIG. 1A, in which the feeder cover is uplifted and the sheet pick-up module and the control lever are exposed.
Figure 1C:
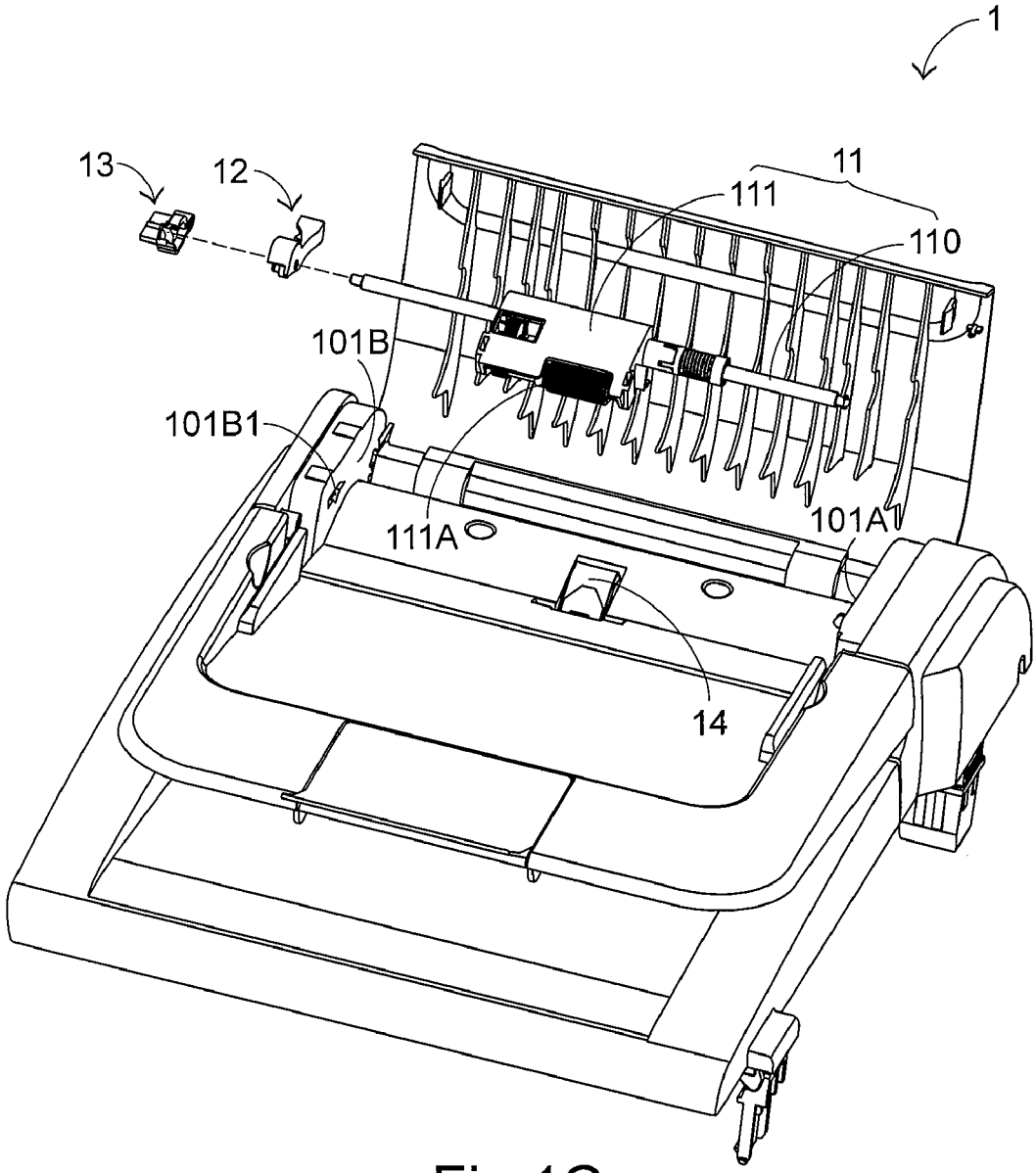
FIG. 1C is a schematic exploded view of the document feeder of FIG. 1A illustrating the relative positions between the sheet pick-up module, the control lever and the base.

Please refer to FIGS. 1A, 1B and 1C. FIG. 1A is a schematic perspective view of a document feeder according to a preferred embodiment of the present invention. FIG. 1B is a schematic perspective view illustrating the document feeder of FIG. 1A, in which the feeder cover is uplifted and the sheet pick-up module and the control lever are exposed. FIG. 1C is a schematic exploded view of the document feeder of FIG. 1A illustrating the relative positions between the sheet pick-up module, the control lever and the base.

Please refer to FIG. 1A and FIG. 1B. The document feeder 1 of the present invention includes a housing 10. The housing 10 has a feeding path 101 for placing therein the documents to be transported therethrough. The feeding path 101 is defined by two sidewalls 101A, 101B and a bottom surface 101C. The document feeder 1 further includes a foldable feeder cover 102 above the feeding path 101. In a case that a paper is jammed in the feeding path 101, as shown in FIG. 1B, the feeder cover 102 can be uplifted to removes the jammed paper.

Figure 2:
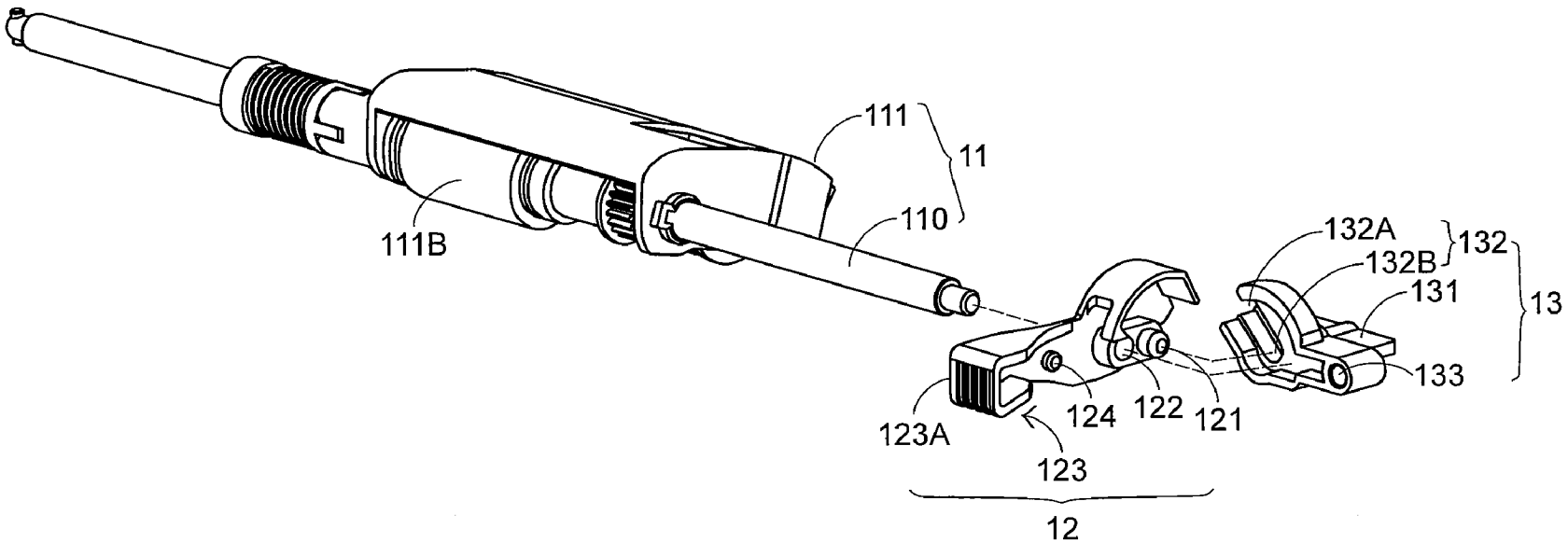
FIG. 2 is a schematic exploded view of the document feeder including the sheet pick-up module, the control lever and the base.

Please refer to FIG. 1B and FIG. 1C. Between the sidewall 101A and the sidewall 101B of the feeding path 101, the document feeder 1 further includes a sheet pick-up module 11, a control lever 12 and a base 13. The sheet pick-up module 11 includes a driving shaft 110 and a sheet pick-up arm 111. The driving shaft 110 has an end coupled to the sidewall 101A, and is driven by a motor (not shown) to rotate. The sheet pick-up arm 111 of the sheet pick-up module 11 includes a sheet pick-up roller 111A and a sheet separation roller 111B (as shown in FIG. 2). The sheet separation roller 111B is also sheathed around the driving shaft 110. When the top paper sheet is transported through the feeding path 101 with rotation of the sheet pick-up roller 111A, the sheet separation roller 111B is rotated on the sheet separation pad 14 to separate the top paper sheet from the stack of paper sheets, thereby picking a single paper.

Please refer to FIG. 1B and FIG. 1C again. The second end of the driving shaft 110 is coupled to the control lever 12, which has a pivotal structure and rotatable. Especially, the axle center of the control lever 12 is not coaxial with the axle center of driving shaft 110. During normal feeding operation of the document feeder 1, the control lever 12 is responsible for supporting the second end of the driving shaft 110 without influencing rotation of the driving shaft 110. Whereas, in a case that a paper is jammed in the feeding path 101, the user may stir the control lever 12 to transmit rotation of the driving shaft 110. Since the driving shaft 110 is non-coaxial with the control lever 12, the axle center of driving shaft 110 is shifted. As a consequence, the sheet separation roller 111B, which is mounted on the driving shaft 110, is also deviated from the original axle center thereof and no longer presses on the jammed paper. Under this circumstance, the user may pull out the jammed paper between the sheet separation roller 111B and the sheet separation pad 14.

In the exploded view of FIG. 1C, the base 13 is disposed on the sidewall 101B of the feeding path 101. The base 13 is able to support the pivotal structure of the control lever 12, and includes a guiding structure for facilitating assembling or disassembling the control lever 12. Hereinafter, the detailed configurations of the control lever 12 and the base 13 are illustrated with reference to FIG. 2, and the relative positions between the control lever 12, the driving shaft 110 and the base 13 are illustrated with reference to FIGS. 3A and 3B.

Please refer to FIG. 2, which is a schematic exploded view of document feeder 1 including the sheet pick-up module 11, the control lever 12 and the base 13. The control lever 12 includes a pivotal part 121, a collar 122 and a handle part 123. In this embodiment, the pivotal part 121 is substantially a cylindrical post serving as a rotating shaft of the control lever 12. The collar 122 is substantially a circular channel sheathed around the driving shaft 110 of the sheet pick-up module 11 such that the driving shaft 110 is rotatably supported by the collar 122. The handle part 123 is a stem-shaped and has a rough surface at a free end thereof for facilitating the user to operate the control lever 12. Especially, the collar 122 is arranged between the pivotal part 121 and the handle part 123. In a case that a paper is jammed in the feeding path 101, the user may stir the handle part 123 of the control lever 12 to rotate the collar 122. Upon rotation of the collar 122, the axle center of driving shaft 110 is shifted because the axle center of the control lever 12 (i.e. the pivotal part 121) is eccentric to the axle center of driving shaft 110. As a consequence, the sheet separation roller 111B, which is mounted on the driving shaft 110, is also deviated from the original axle center thereof and no longer presses on the jammed paper.

Please refer to FIG. 2 and FIG. 1C. The base 13 includes a fixing structure 131 and a guiding slot 132. The fixing structure 131 is a horizontal wing protruded from a lateral side of the base 13 to be embedded into a recess structure 101B1 in the sidewall 101B. The guiding slot 132 has an entrance 132A and an arc-shape bottom surface 132B. When the control lever 12 is combined with the base 13, the pivotal part 121 glides along the guiding slot 132 through the entrance 132A. As a consequence, the pivotal part 121 is rotatably supported by the arc-shape bottom surface 132B. Whereas, when the pivotal part 121 is pulled out from the guiding slot 132 through the entrance 132A, the control lever 12 will be detached from the base 13.

Referring to FIG. 2 again, the control lever 12 and the base 13 include a salient portion 124 and an indentation portion 133, respectively. When the salient portion 124 is engaged with the indentation portion 133, the control lever 12 is fixed onto the base 13. That is, during normal feeding operation of the document feeder 1, the engagement of the salient portion 124 and the indentation portion 133 prevents the control lever 12 from rotating relative to the base 13. Meanwhile, the driving shaft 110 is rotatably supported by the collar 122.

Figure 3A:
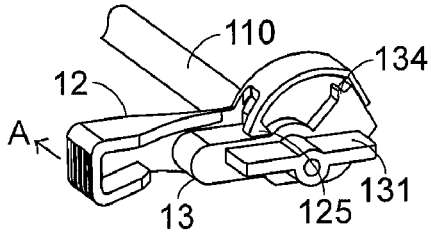
FIGS. 3A and 3B are schematic views illustrating the process of removing a jammed paper by adjusting the control lever to a jammed paper elimination position.
Figure 3B:
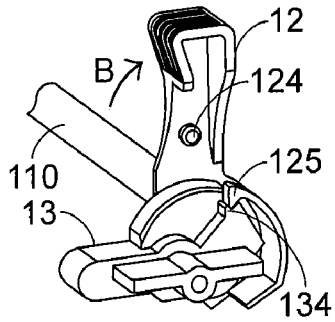

Hereinafter, a process of removing a jammed paper by operating the control lever 12 will be illustrated with reference to FIGS. 3A and 3B. First of all, after the salient portion 124 is engaged with the indentation portion 133 (as shown in FIG. 2), the control lever 12 is fixed onto the base 13. Meanwhile, the driving shaft 110 is rotatably supported by the collar 122. In a case that a paper is jammed in the feeding path 101, the user may stir the control lever 12 in the direction indicated by the arrow A (as shown in FIG. 3A), so that the salient portion 124 is disengaged from the indentation portion 133. Next, as shown in FIG. 3B, the user may stir the control lever 12 in the direction indicated by the arrow B to transmit rotation of the driving shaft 110. Since the driving shaft 110 is non-coaxial with the control lever 12, the axle center of driving shaft 110 is shifted. As a consequence, the sheet separation roller 111B, which is mounted on the driving shaft 110, is also deviated from the original axle center thereof and no longer presses on the jammed paper. Under this circumstance, the user may pull out the jammed paper between the sheet separation roller 111B and the sheet separation pad 14.

Please refer to FIGS. 3A and 3B again. When the control lever 12 is rotated in the direction B to the upright position perpendicular to the original position thereof, the control lever 12 is raised to the highest level relative to the sheet separation pad 14. That is, the maximum gap between the sheet separation roller 111B and the sheet separation pad 14 facilitates pulling out the jammed paper without difficulty. Moreover, the control lever 12 further includes a resilient hooking part 125 corresponding to a protrusion structure 134 on the base 13. After the control lever 12 is rotated to the upright position as shown in FIG. 3B, the resilient hooking part 125 may be hooked onto the protrusion structure 134, so that the control lever 12 is fixed in the upright position, which is also referred hereinafter as a jammed paper elimination position.

Figure 3C:
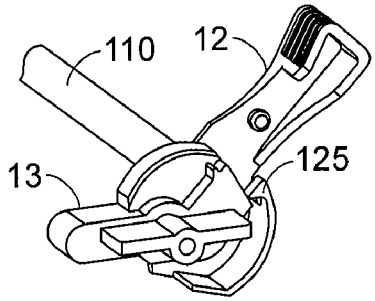
FIG. 3C is a schematic view illustrating that the control lever is adjusted to a detachment position.
Figure 3D:
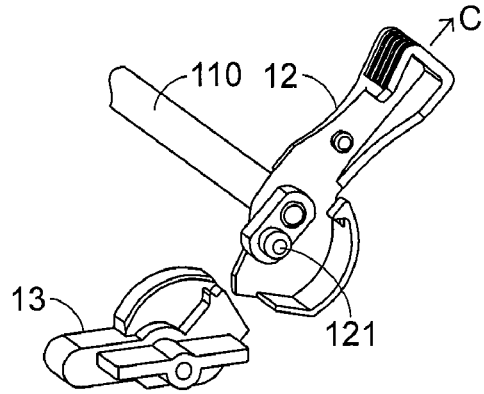
FIG. 3D is a schematic view illustrating that the control lever is detached from the base.

As previously described, the sheet pick-up module 11 of the document feeder 1 is readily suffered from abrasion when it has been used for a long term. For replacing the sheet pick-up module 11, the resilient hooking part 125 is disengaged from the protrusion structure 134 and then the control lever 12 is rotated from the jammed paper elimination position as shown in FIG. 3B to a detachment position as shown in FIG. 3C. In this embodiment, the detachment position is slightly behind the jammed paper elimination position. After the control lever 12 is rotated to the detachment position, the control lever 12 is withdrawn from the base 13 in the direction indicated in the arrow C such that the control lever 12 is detached from the base 13, as is shown in FIG. 3D. Meanwhile, the abraded sheet pick-up module may be replaced with a sheet pick-up module replacement.

From the above description, the document feeder of the present invention is capable of removing the jammed paper without difficulty by adjusting the control lever to the jammed paper elimination position. In addition, the abraded sheet pick-up module can be detached from the document feeder by adjusting the control lever to the detachment position.

While the invention has been described in terms of what is presently considered to be the most practical and preferred embodiments, it is to be understood that the invention needs not be limited to the disclosed embodiment. On the contrary, it is intended to cover various modifications and similar arrangements included within the spirit and scope of the appended claims which are to be accorded with the broadest interpretation so as to encompass all such modifications and similar structures.

What is claimed is:

1. A document feeder comprising:

a housing including a feeding path defined by a first sidewall and a second sidewall;

a control lever mounted on said first sidewall and including a pivotal part at one end thereof, a collar and a handle part at an opposite end thereof, wherein said collar is arranged between said pivotal part and said handle part, wherein said control lever pivots about said pivotal part; and a sheet pick-up module including a driving shaft mounted on said collar and said second sidewall.

2. The document feeder according to claim 1 further comprising a base between said first sidewall and said control lever for supporting said pivotal part of said control lever.

3. The document feeder according to claim 2 wherein said control lever and said base include a salient portion and an indentation portion, respectively, wherein said control lever is fixed onto said base when salient portion is engaged with said indentation portion.

4. The document feeder according to claim 2 wherein said base further includes a guiding slot having an entrance and an arc-shape bottom surface, wherein said pivotal part of said control lever glides along said guiding slot through the entrance and is supported on said arc-shape bottom surface.

5. The document feeder according to claim 1 wherein said driving shaft includes an original axle center, and wherein said control lever pivots about said pivot part between a closed position in which said sheet pick-up module is operational, a jammed paper elimination position in which said driving shaft is deviated from said original axle center, and a detachment position in which said control lever is removable from said document feeder.

6. A document feeder comprising:

a housing including a feeding path defined by a first sidewall and a second sidewall;

a control lever mounted on said first sidewall and including a pivotal part at one end thereof, a collar and a handle part at an opposite end thereof, wherein said collar is arranged between said pivotal part and said handle part, wherein said control lever pivots about said pivotal part;

a base between said first sidewall and said control lever for supporting said pivotal part of said control lever, wherein said control lever and said base include a salient portion and an indentation portion, respectively, wherein said control lever is fixed onto said base when salient portion is engaged with said indentation portion, wherein said base further includes a guiding slot having an entrance and an arc-shape bottom surface, wherein said pivotal part of said control lever glides along said guiding slot through the entrance and is supported on said arc-shape bottom surface; and a sheet pick-up module including a driving shaft mounted on said collar and said second sidewall.

7. The document feeder according to claim 6 wherein said driving shaft includes an original axle center, and wherein said control lever is pivotable about said pivot part between a closed position in which said sheet pick-up module is operational, a jammed paper elimination position in which said driving shaft is deviated from said original axle center, and a detachment position in which said control lever is removable from said document feeder.

* * * * *